US008012271B2

(12) United States Patent
Smarsly et al.

(10) Patent No.: US 8,012,271 B2
(45) Date of Patent: Sep. 6, 2011

(54) MATERIAL FOR COMPONENTS OF A GAS TURBINE

(75) Inventors: Wilfried Smarsly, Munich (DE); Gerhard Sauthoff, Ratingen (DE)

(73) Assignee: MTU Aero Engines GmbH, Munich (DE)

( * ) Notice: Subject to any disclaimer, the term of this patent is extended or adjusted under 35 U.S.C. 154(b) by 469 days.

(21) Appl. No.: 12/158,202

(22) PCT Filed: Dec. 15, 2006

(86) PCT No.: PCT/DE2006/002239

§ 371 (c)(1),
(2), (4) Date: Oct. 23, 2008

(87) PCT Pub. No.: WO2007/076805

PCT Pub. Date: Jul. 12, 2007

(65) Prior Publication Data

US 2009/0202381 A1 Aug. 13, 2009

(30) Foreign Application Priority Data

Dec. 23, 2005 (DE) ..... 10 2005 061 790

(51) Int. Cl.

| | |
|---|---|
| ***C22C 38/18*** | (2006.01) |
| ***C22C 38/06*** | (2006.01) |
| ***C22C 27/02*** | (2006.01) |
| ***C22C 30/00*** | (2006.01) |

(52) U.S. Cl. ..... 148/326; 148/328; 148/419; 420/79; 420/83; 420/104; 420/583; 420/40

(58) Field of Classification Search ..... 420/34, 420/40, 79, 104, 583, 83, 425; 148/325, 148/326, 419, 328

See application file for complete search history.

(56) References Cited

U.S. PATENT DOCUMENTS

| | | | | |
|---|---|---|---|---|
| 4,946,646 | A * | 8/1990 | Gamo et al. | 420/415 |
| 2002/0020473 | A1 * | 2/2002 | Sawaragi et al. | 148/325 |
| 2005/0217765 | A1 * | 10/2005 | Inoue et al. | 148/325 |

FOREIGN PATENT DOCUMENTS

| | | |
|---|---|---|
| DE | 19928842 | 1/2001 |
| EP | 0 533 059 | 3/1993 |
| JP | 05209249 | 8/1993 |

OTHER PUBLICATIONS

Risanti et al., "Strengthening of iron aluminige alloys by atomic ordering and Laves phase precipitation for high temperature applications." Intermetallics, Bd. 13, Apr. 7, 2005.

Klower et al., "Development of high-temperature corrosion-resistant Fe-Cr-Al alloys for metallic automobile exhaust gas catalyst supports." Werkst. Verfahrenstech, Symposium, Werkstoffwoche, Bd. 2, 1999.

International Search Report corresponding to International Application Serial No. PCT/DE2006/002239, mailed May 7, 2007.

* cited by examiner

*Primary Examiner* — Deborah Yee

(74) *Attorney, Agent, or Firm* — McAndrews, Held & Malloy, Ltd.

(57) ABSTRACT

The presently described technology relates to a material for components of a gas turbine, in particular for components of a gas turbine aircraft engine, having a matrix of an iron-based alloy material, wherein the matrix of the iron-based alloy material being hardened by means of an intermetallic material of the Laves phase.

20 Claims, No Drawings

MATERIAL FOR COMPONENTS OF A GAS TURBINE

RELATED APPLICATIONS

This application is a U.S. National Stage Filing of International Application No. PCT/DE2006/002239 (International Publication Number WO/2007/076805), having an International filing date of Dec. 15, 2006 entitled "Werkstoff Fü Bauteile Einer Gasturbine" ("Material For Components Of A Gas Turbine"). International Application No. PCT/DE/2006/002239 claimed priority benefits, in turn, from German Patent Application No. 10 2005 061 790.5, filed Dec. 23, 2005. International Application No. PCT/DE/2006/002239 and German Application No. 10 2005 061 790.5 are hereby incorporated by reference herein in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The presently described technology relates to a material for components of a gas turbine.

Modern gas turbines, in particular aircraft propulsion systems, have to meet very stringent requirements with respect to reliability, weight, performance, efficiency and life span. In the development of gas turbines, the choice of material; the search for new suitable materials; and the search for new production methods are crucial factors. The most important materials that are currently used for aircraft propulsion systems or other gas turbines are titanium alloys, nickel alloys and high strength steels. The high strength steels are used for shaft parts, gear parts, the compressor housing and the turbine housing. Titanium alloys are the standard materials for compressor parts. Nickel alloys are suitable for the hot turbine parts of an aircraft propulsion system.

Whenever during the operation of a gas turbine the components of the gas turbine are exposed to temperatures exceeding approximately 900° C., the standard procedure is to use so-called ODS materials (oxide dispersion strengthened superalloys), CMC materials (ceramic matrix composites), or intermetallic NiAl (nickel aluminum) materials and/or intermetallic TiAl (titanium aluminum) materials as the materials for such components. However, these materials are relatively expensive, so that there is a need for a novel material that is suitable for gas turbine components that are exposed to temperatures exceeding approximately 900° C.

BRIEF SUMMARY OF THE INVENTION

Against this background, the present technology is based on the need of providing a novel material for components of a gas turbine.

This need is addressed by a material, for example, a matrix material. In particular, the matrix material is composed of an iron based alloy material being hardened with an intermetallic material of the Laves phase.

The matrix material represents a cost effective alternative for the prior art materials and is suitable primarily for gas turbine components that are exposed to temperatures exceeding approximately 900° C. The cost of the components of gas turbines can be reduced by means of the material of the matrix described herein.

Preferably the matrix material comprises 70.0 to 99.9% by volume of the iron based alloy material and 0.1 to 30.0% by volume of the intermetallic material of the Laves phase.

Preferred farther developments of the invention are disclosed in the dependent claims and the following description. One embodiment of the invention is explained in detail below without restricting the invention to this embodiment.

BRIEF DESCRIPTION OF SEVERAL VIEWS OF THE DRAWINGS

[Not Applicable]

DETAILED DESCRIPTION OF THE INVENTION

The presently described technology, described here, constitutes a novel material for components of a gas turbine, in particular for components of gas turbine aircraft propulsion systems that are exposed in operation to temperatures of preferably more than 900° C. The material has a matrix composed of an iron based alloy material, with the matrix composed of the iron based alloy material being hardened with an intermetallic material of the Laves phase. The Laves phase is a hexagonal intermetallic phase.

The intermetallic material of the Laves phase is incorporated and/or embedded into the matrix composed of the iron-based alloy material. In this case, the material has preferably the following composition:

a. 70.0 to 99.9% by volume of the iron based alloy material, and
b. 0.1 to 30.0% by volume of the intermetallic material of the Laves phase.

The iron based alloy material of the matrix of the presently described material comprises, at least, iron (Fe), aluminum (Al), chromium (Cr), yttrium (Y) and/or hafnium (Hf). Preferably, the iron based alloy material of the matrix of the material described herein has the follow composition:

31.0 to 91.9% by weight of iron, and
6.0 to 40.0% by weight of aluminum, and
2.0 to 25.0% by weight of chromium, and
0.1 to 2.0% by weight of yttrium, and/or
0.1 to 2.0% by weight of hafnium, where the above constituents are selected in such a manner that the sum is equal to 100% by weight.

The intermetallic material of the Laves phase that is used for the purpose of hardening the matrix comprises, at least, iron (Fe), aluminum (Al), niobium (Nb) and/or tantalum (Ta). This intermetallic material of the Laves phase has preferably the following composition:

15.0 to 65.0% by weight of iron, and
1.0 to 15.0% by weight of aluminum, and
0.5 to 55.0% by weight of niobium, and/or
0.5 to 65.0% by weight of tantalum, where the above constituents are adjusted as a function of the matrix composition in such a manner that the sum is equal to 100% by weight.

Furthermore, the invention relates to a component of a gas turbine, preferably a gas turbine aircraft propulsion system, which is made of such a material. Therefore, the inventive material is suitable, in particular, for the production of housings, like combustion chamber housings, high pressure compressor housings, or low pressure turbine housings. Furthermore, the presently described material is suitable, for example, for the production of exhaust gas conduits, diffusor components, brush seals and sealing elements that are used in the inner air seal region and the outer air seal region of a turbine, in particular, of a low pressure turbine and/or a compressor of a gas turbine aircraft propulsion system.

The invention has now been described in such full, clear, concise and exact terms as to enable any person skilled in the art to which it pertains, to practice the same. It is to be understood that the foregoing describes preferred embodiments and examples of the invention and that modifications may be made therein without departing from the spirit or scope of the invention as set forth in the claims. Moreover, while particular elements, embodiments and applications of the present technology have been shown and described, it will be understood, of course, that the present technology is not limited thereto since modifications can be made by those skilled in the art without departing from the scope of the present disclosure, particularly in light of the foregoing teachings and appended claims. Moreover, it is also understood that the embodiments shown in the drawings, if any, and as described above are merely for illustrative purposes and not intended to limit the scope of the invention, which is defined by the following claims as interpreted according to the principles of patent law, including the Doctrine of Equivalents. Further, all references cited herein are incorporated in their entirety.

The invention claimed is:

1. A material for use as a component of a gas turbine system, said material having a matrix composed of an iron based alloy material, wherein the matrix composed of the iron based alloy material is hardened with an intermetallic material of the Laves phase, wherein the iron based alloy material comprises 31.0 to 91.9% by weight of iron, 6.0 to 40.0% by weight of aluminum, 2.0 to 25.0% by weight of chromium and 0.1 to 2.0% by weight of yttrium.

2. The material for use as a component of a gas turbine system of claim 1, wherein the intermetallic material of the Laves phase is incorporated in the matrix composed of the iron based alloy material.

3. The material for use as a component of a gas turbine system of claim 1, wherein the material comprises 70.0 to 99.9% by volume of the iron based alloy material, and 0.1 to 30.0% by volume of the intermetallic material of the Laves phase.

4. The material for use as a component of a gas turbine system of claim 1, wherein the iron based alloy material further comprises 0.1 to 2.0% by weight of hafnium.

5. The material for use as a component of a gas turbine system of claim 1, wherein the intermetallic material of the Laves phase comprises at least one of iron, aluminum, niobium or tantalum.

6. The material for use as a component of a gas turbine system of claim 5, wherein the intermetallic material of the Laves phase comprises 15.0 to 65.0% by weight of iron, 1.0 to 15.0% by weight of aluminum, and 0.5 to 55.0% by weight of niobium.

7. The material for use as a component of a gas turbine system of claim 6, wherein the intermetallic material of the Laves phase further comprises 0.5 to 65.0% by weight of tantalum.

8. The material for use as a component of a gas turbine system of claim 5, wherein the intermetallic material of the Laves phase comprises 15.0 to 65.0% by weight of iron, 1.0 to 15.0% by weight of aluminum, and 0.5 to 65.0% by weight of tantalum.

9. A material for use as a component of a gas turbine system, said material having a matrix composed of an iron based alloy material, wherein the matrix composed of the iron based alloy material is hardened with an intermetallic material of the Laves phase, wherein the iron based alloy material comprises 31.0 to 91.9% by weight of iron, 6.0 to 40.0% by weight of aluminum, 2.0 to 25.0% by weight of chromium and 0.1 to 2.0% by weight of hafnium.

10. The material for use as a component of a gas turbine system of claim 9, wherein the intermetallic material of the Laves phase is incorporated in the matrix composed of the iron based alloy material.

11. The material for use as a component of a gas turbine system of claim 9, wherein the material comprises 70.0 to 99.9% by volume of the iron based alloy material, and 0.1 to 30.0% by volume of the intermetallic material of the Laves phase.

12. The material for use as a component of a gas turbine system of claim 9, wherein the intermetallic material of the Laves phase comprises at least one of iron, aluminum, niobium or tantalum.

13. The material for use as a component of a gas turbine system of claim 12, wherein the intermetallic material of the Laves phase comprises 15.0 to 65.0% by weight of iron, 1.0 to 15.0% by weight of aluminum, and 0.5 to 55.0% by weight of niobium.

14. The material for use as a component of a gas turbine system of claim 13, wherein the intermetallic material of the Laves phase further comprises 0.5 to 65.0% by weight of tantalum.

15. The material for use as a component of a gas turbine system of claim 12, wherein the intermetallic material of the Laves phase comprises 15.0 to 65.0% by weight of iron, 1.0 to 15.0% by weight of aluminum, and 0.5 to 65.0% by weight of tantalum.

16. A material for use as a component of a gas turbine system, said material having a matrix composed of an iron based alloy material, wherein the matrix composed of the iron based alloy material is hardened with an intermetallic material of the Laves phase, wherein the intermetallic material of the Laves phase comprises 15.0 to 65.0% by weight of iron, 1.0 to 15.0% by weight of aluminum, and 0.5 to 55.0% by weight of niobium.

17. The material for use as a component of a gas turbine system of claim 16, wherein the intermetallic material of the Laves phase further comprises 0.5 to 65.0% by weight of tantalum.

18. The material for use as a component of a gas turbine system of claim 16, wherein the intermetallic material of the Laves phase is incorporated in the matrix composed of the iron based alloy material.

19. The material for use as a component of a gas turbine system of claim 16, wherein the material comprises 70.0 to 99.9% by volume of the iron based alloy material, and 0.1 to 30.0% by volume of the intermetallic material of the Laves phase.

20. The material for use as a component of a gas turbine system of claim 16, wherein the iron based alloy material comprises at least one of iron, aluminum, chromium, yttrium or hafnium.

* * * * *